United States Patent [19]

Belden

[11] Patent Number: 4,629,073

[45] Date of Patent: Dec. 16, 1986

[54] BELT BUCKLE RACK

[76] Inventor: Walter R. Belden, 300 E. Proseer Rd., #25A, Cheyenne, Wyo. 82007

[21] Appl. No.: 700,006

[22] Filed: May 8, 1985

[51] Int. Cl.[4] ..... A47F 7/19

[52] U.S. Cl. ..... 211/60.1; 211/13; 206/486

[58] Field of Search ..... 211/60.1, 13, 87; 248/220.3, 224.4; 206/486, 490, 476; 403/339

[56] References Cited

U.S. PATENT DOCUMENTS

| | | | |
|---|---|---|---|
| 1,130,610 | 3/1915 | Kane | 403/339 |
| 1,410,925 | 3/1922 | Kempton | 206/486 X |
| 1,445,795 | 2/1923 | Parker | 206/486 X |
| 2,868,371 | 1/1959 | Thorpe | 206/486 X |
| 2,962,161 | 11/1960 | Lacy | 206/486 X |
| 3,187,903 | 6/1965 | Oltz | 211/87 |
| 3,497,074 | 2/1970 | Shaheen | 211/13 |
| 3,516,634 | 6/1970 | Salaua et al. | 211/87 X |

*Primary Examiner*—Ramon S. Britts
*Assistant Examiner*—Blair M. Johnson
*Attorney, Agent, or Firm*—Roylance, Abrams, Berdo & Goodman

[57] ABSTRACT

There is a disclosed a belt buckle holder which is adapted to be mounted flush against a wall. The holder comprises a front portion having a planar surface. The front portion contains a plurality of perforations, each adapted to receive the tongue of a belt buckle. A back portion is provided which is affixed to the back of the front portion. This back portion covers the perforations in the front portion to prevent the tongues of belt buckles inserted therein from scratching the surface underlying the back portion of the belt buckle holder when mounted on a wall.

6 Claims, 5 Drawing Figures

BELT BUCKLE RACK

BACKGROUND OF THE INVENTION

This invention relates to a belt buckle holder adapted to be mounted flush against a wall.

Perforated panels are commonly mounted on walls and fixtures of various kinds and configurations are hooked into the perforations of the panels for supporting merchandise, tools, kitchen utensils, and other objects. The fixtures, which extend completely through the perforations of the panel from front to back, are likely to cause scratching of the underlying surface.

SUMMARY OF THE INVENTION

A belt buckle holder is provided which is adapted to be mounted flush against a wall. The holder comprises a front portion having a planar surface. The front portion contains a plurality of perforations, each adapted to receive the tongue of a belt buckle. A back portion is provided which is affixed to the back of the front portion. This back portion covers the perforations in the front portion to prevent the tongues of belt buckles inserted therein from scratching the surface underlying the back portion of the belt buckle holder when mounted on a wall.

DETAILED DESCRIPTION OF THE INVENTION

Figure 1:
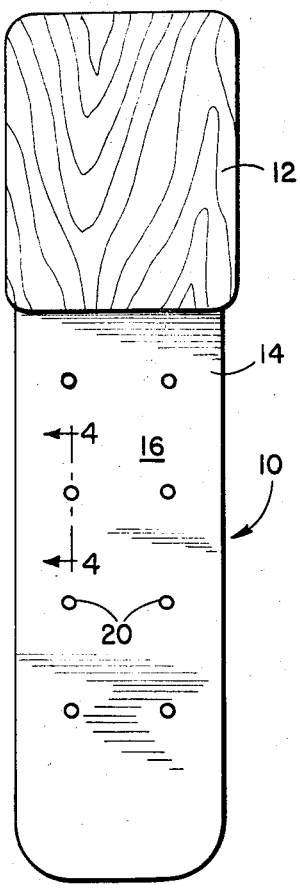
FIG. 1 is a plan view of the front of the belt buckle rack.
Figure 2:
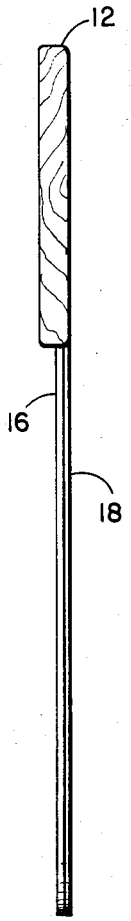
FIG. 2 is a plan view of the side of the belt buckle rack. The other side is identical.
Figure 3:
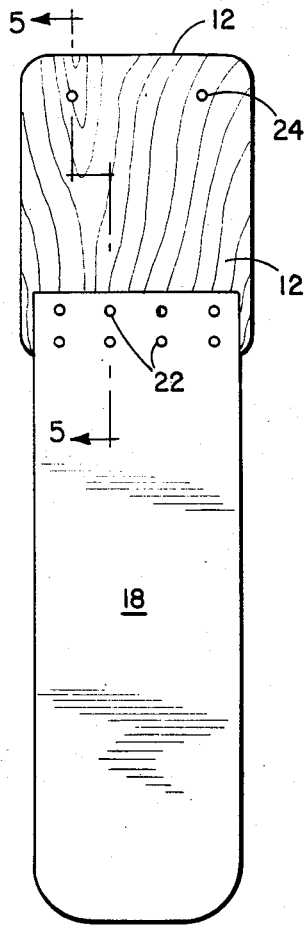
FIG. 3 is a plan view of the back of the belt buckle rack.

Referring to FIGS. 1, 2, and 3, there is shown a belt buckle holder 10 comprising a headpiece 12 and a body piece 14. The body piece 14 comprises a planar front portion 16 and a planar back portion 18. The front portion contains a plurality of perforations 20, each of which is adapted to receive the tongue of a belt buckle. Belt buckles which may be mounted in the perforations are, e.g., conventional Western-type belt buckles which are detachable from the belt itself. The provision of a large number of belt buckles permits a great deal of variance and appearance of the wearer while requiring only a single belt. The belt buckles per se are conventional and do not form a part of this invention.

Figure 4:
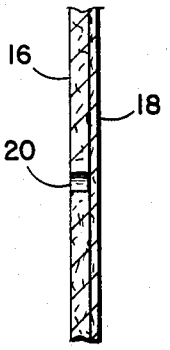
FIG. 4 is a partial cross-sectional view of the belt buckle rack taken along line 4—4 of FIG. 1.

The back portion 18 of the body piece 14 covers the entire back of the front portion 16. It may be affixed to the front portion 16 by means of glue and/or stitching around the edges of the holder. The back portion 18 covers the perforations 20 in the front portion 16, thereby preventing the tongues of belt buckles which are inserted into the perforations from scratching the wall surface underlying the back portion of the belt buckle holder. This is illustrated in FIG. 4 and shows that a perforation 20 does not extend all the way through the thickness of the body piece 14. It will be understood that back portion 18 is affixed to the front portion 16 only at the edges thereof, i.e., they are not integral throughout the entire portion of the body piece 14 so as to provide space between front portion 16 and back portion 18 into which the tongue of a belt buckle may extend. The tongue of a belt buckle extends through the perforation 20 and either up, down or sideways in the space between front portion 16 and back portion 18.

The front portion may be, for example, genuine cowhide, to which sealer may be applied to prevent aging. Typically, the front portion 16 may be seven inches wide and 24 inches long. The size may be varied to accommodate fewer or more belt buckles. The front portion may be tooled and personalized with a name or initials. It may contain two vertical rows of perforations as shown, or a single row of perforations.

The back portion 18 may comprise a much lighter piece of leather or some other material. It is the same dimensions as the front portion 16 and, as previously described, is glued or sewn to the back of the front portion along the edges thereof.

Figure 5:
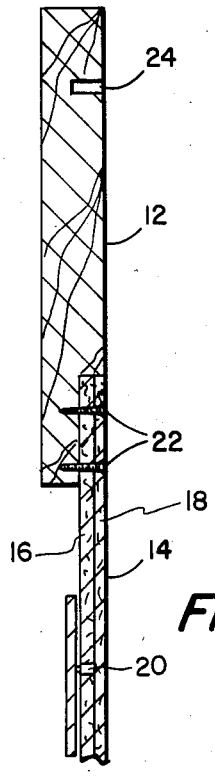
FIG. 5 is a partial cross-sectional view taken along line 5—5 of FIG. 3.

The headpiece 12 may be made of wood, such as oak, with the edges tooled. It may be varnished in its natural color. Typically, the headpiece 12 is eight inches wide, ¾ inch thick, and 11 inches high. As shown in FIGS. 3 and 5, the lower portion of the back of the headpiece 12 may be mortised so that the body piece 14 fits into the mortised portion, thus presenting a flush surface on the back side. The body piece 14 may be secured to the headpiece 12 by means of screws 22. The headpiece 12 is also provided with perforations 24 which extend only a portion of the way through the headpiece to permit mounting of the holder onto fastening means, e.g., screws, mounted in a wall.

FIG. 5 illustrates holder 10 in use. The tongue of belt buckle 30 is received within a slot 20, retaining belt buckle 30 in holder 10.

What is claimed is:

1. A belt buckle holder comprising:
   - a decorative head piece designed to be mounted on a support surface; and
   - a body piece comprised of a front and back element, each having a flat front and back surface;
   - said body piece being attached to said head piece and extending downward therefrom;
   - said front element overlying said back element;
   - said front element having holes therethrough being exposed on said front element's flat front surface to receive tongues of belt buckles;
   - said back element being continuous behind said holes;
   - said head piece being comprised of wood a rigid material and said body piece being comprised of leather a flexible material;
   - said head piece having a mortised lower edge, said body piece engaging said mortised lower edge such that the back surfaces of said head piece and said body piece are in substantially the same plane.

2. A belt buckle holder according to claim 1 wherein said back element completely underlies said front element.

3. A belt buckle holder according to claim 2 wherein said front and back elements are of the same approximate size and shape.

4. A belt buckle holder according to claim 3 wherein the back element is a continuous piece of material.

5. A belt buckle holder according to claim 3 wherein said back element is attached to said front element.

6. A belt buckle holder according to claim 5 wherein said back element is attached to the front element only along the periphery of said elements.

* * * * *